US006540079B1

(12) United States Patent
Garcia et al.

(10) Patent No.: US 6,540,079 B1
(45) Date of Patent: Apr. 1, 2003

(54) PRODUCT PACKAGING UNDER FILM-SEALED SHELL

(75) Inventors: Firmin Garcia, Evreux (FR); Aline Abergel, Boulogne-Billancourt (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/807,307

(22) PCT Filed: Oct. 12, 1999

(86) PCT No.: PCT/FR99/02444

§ 371 (c)(1),
(2), (4) Date: Jun. 6, 2001

(87) PCT Pub. No.: WO00/21853

PCT Pub. Date: Apr. 20, 2000

(30) Foreign Application Priority Data

Oct. 13, 1998 (FR) ..... 98 12779

(51) Int. Cl.[7] ..... B65D 73/00; B65D 35/56

(52) U.S. Cl. ..... 206/484; 222/105; 222/107

(58) Field of Search ..... 222/92, 93, 88, 222/105–107, 215; 206/484, 461, 469, 466

(56) References Cited

U.S. PATENT DOCUMENTS

| | | | | | |
|---|---|---|---|---|---|
| 2,152,862 | A | * | 4/1939 | Bergerioux | 222/105 |
| 3,315,801 | A | * | 4/1967 | Lowry | 206/469 |
| 3,333,684 | A | | 8/1967 | Marrtelli | |
| 3,469,743 | A | * | 9/1969 | Becker | 222/105 |
| 3,741,384 | A | * | 6/1973 | Cloud | 206/461 |
| 3,933,296 | A | | 1/1976 | Ruskin et al. | |
| 3,979,020 | A | | 9/1976 | Braber et al. | |
| 4,169,531 | A | | 10/1979 | Wood | |
| 4,218,155 | A | * | 8/1980 | Weidner | 206/484 |
| 4,524,871 | A | | 6/1985 | Klinger | |
| 5,344,018 | A | | 9/1994 | Severin | |
| 5,425,480 | A | * | 6/1995 | Rabenau et al. | 206/461 |
| 5,645,527 | A | * | 7/1997 | Beck | 222/107 |

FOREIGN PATENT DOCUMENTS

| | | |
|---|---|---|
| FR | 2 611 665 A | 9/1988 |
| FR | 2 638 140 A | 4/1990 |
| FR | 2 694 741 A | 2/1994 |
| WO | WO 88/04264 A1 | 6/1988 |

OTHER PUBLICATIONS

Search Report (French) for FR 9812779.
Search Report (French) for PCT/FR99/02444.

* cited by examiner

*Primary Examiner*—Bryon P. Gehman
(74) *Attorney, Agent, or Firm*—Wood, Phillips, Katz, Clark & Mortimer

(57) ABSTRACT

Product packaging is provided with a shell forming at least one portion in relief and a sealing film connected to the shell except at the one portion in relief, so as to form at least one product reservoir. The shell is covered at least in part by a flap. The flap is integral with or secured to the shell and/or the film via two opposite edges.

16 Claims, 2 Drawing Sheets

PRODUCT PACKAGING UNDER FILM-SEALED SHELL

This application is an application filed under 35 U.S.C. Sec. 371 as a national stage of international application PCT/FR99/02444, which was filed Oct. 12, 1999.

The present invention relates to packaging for packaging a product, which may be either liquid or solid, in one or more reservoirs formed by a shell sealed with a film. Such inexpensive packaging is often distributed as a product sample for promotional purposes. A preferred application of the invention is thus to perfumery and cosmetics. The products packaged may be of all types, such as, for example, perfumes, creams, lipsticks, or eye-shadow.

BACKGROUND OF THE INVENTION

A technique that is simple and in wide use for packaging such products in the form of samples consists in thermoforming a plastics sheet so as to form a shell defining at least one concave portion that is filled with the desired product, a sealing film then being bonded to the shell but not to the concave portion, so that the film co-operates with the shell to define at least one reservoir. The shell thus defines substantially two zones, namely a plane zone to which the sealing film is bonded, and one or more zones in relief which define the reservoir(s). In general, the sealing film constitutes the back of the packaging while the thermoformed shell defines the top on which the brand and the type of the product may, for example, be indicated. The thermoformed shell thus constitutes an advertising or promotional medium for the manufacturer or for the distributor of the packaged product.

Unfortunately, the convex zone of the thermoformed shell considerably limits the area that can be used for advertising, which is often reduced to its central portion where the shape is less curved. In addition, the fact that said zone is not plane makes it difficult to print on it or to stick a label on it to indicate the type and the brand of the product. Outside the nevertheless convex central zone, it is not possible to use any other zone of the shell for indications relating to the product. The plane zone surrounding the convex zone is limited because it defines merely a narrow flange that extends around the convex zone which defines the reservoir. In addition, because of the technique that is used, i.e;. thermoforming, it is not possible to form a shell having a desired aesthetically-pleasing appearance because the shaped zone that forms the reservoir must be surrounded by the peripheral plane flange zone, which spoils its appearance. The peripheral plane zone is necessary for bonding the sealing film that closes the reservoir.

In addition, the use of the back, i.e. the sealing film, as the display medium is either impossible in practice, or at least unpleasing in appearance. In its portion in which it forms part of the reservoir, the film does not have a surface that is perfectly plane, indeed it is deformed or undulating. Furthermore, in its portion that is bonded to the shell, the film has a surface that is crinkled and that is unsuitable for receiving printing. The sealing film does not therefore form a good surface on which to place indications relating to the product.

Document U.S. Pat. No. 4,169,531 discloses packaging for tablets. That packaging comprises a thermoformed shell defining portions in relief that form reservoirs or "blisters" for receiving individual tablets. The shell also forms a protective flap in the form of a cover that is hinged along one edge and that can be brought back over the individual blisters. A seal is applied over the blisters so as to isolate them from one another. To remove a tablet from its blister, the cover must first be opened, and then a finger must be used to press on a portion in relief of the blister, thereby breaking the seal. The sole purpose of the hinged cover is thus to prevent any blister from being pushed in accidentally. Once it has been opened, it no longer offers a surface that is suitable for displaying indications placed thereon.

SUMMARY OF THE INVENTION

An object of the present invention is to remedy the drawbacks of the prior art by defining product packaging firstly that offers a more attractive appearance, and secondly that defines a larger suitable zone on which to indicate the brand and the type of the product.

To this end, the present invention provides product packaging comprising a shell forming at least one portion in relief and a sealing film connected to the shell except at said at least one portion in relief, so as to form at least one product reservoir, the shell being covered at least in part by a flap, said flap being integral with or secured to the shell and/or the film via two opposite edges. Thus, the flap firstly masks the reservoir which is sometimes of unpleasing appearance, and secondly offers a larger advertising-medium zone.

According to an advantageous characteristic of the invention, the flap is formed by the sealing film, by the shell, or by both. The flap is in the form of an extension to the film and/or to the shell that is brought back over the shell by being pivoted or folded back along a hinge. The edge opposite from the hinge is then secured permanently to the shell and/or to the film. The fixing is indeed permanent so that the flap masks the shell permanently.

In another embodiment, the flap may be formed by a separate sheet that is fixed to the shell or to the film. In which case, although the term "flap" is used, it is actually an independent sheet that is mounted on the shell or on the film.

In an embodiment of pleasing appearance, the flap may be provided with at least one window at the reservoir so as to reveal a portion of the shell aesthetically. This window may advantageously have an attractive shape such as the outline of a perfume bottle when the packaging forms a perfume sample.

In addition, the portion in relief may define an actuating wall for extracting product by pressing on said reservoir, the product advantageously being extracted via a spray nozzle. The mode of extracting the product from the reservoir is largely dependent on the nature of the packaged product, i.e. whether it is liquid, semi-liquid, or solid. In this case, the actuating wall is pushed in through the flap. In an embodiment, a portion of the sealing film can be peeled off so as to open the reservoir directly, or so as to reveal an outlet orifice, e.g. the outlet orifice of a nozzle.

The invention is described more fully below with reference to the accompanying drawings which show embodiments of the invention by way of non-limiting example.

DETAILED DESCRIPTION OF THE PREFERRED EMBODIMENTS

Figure 1:
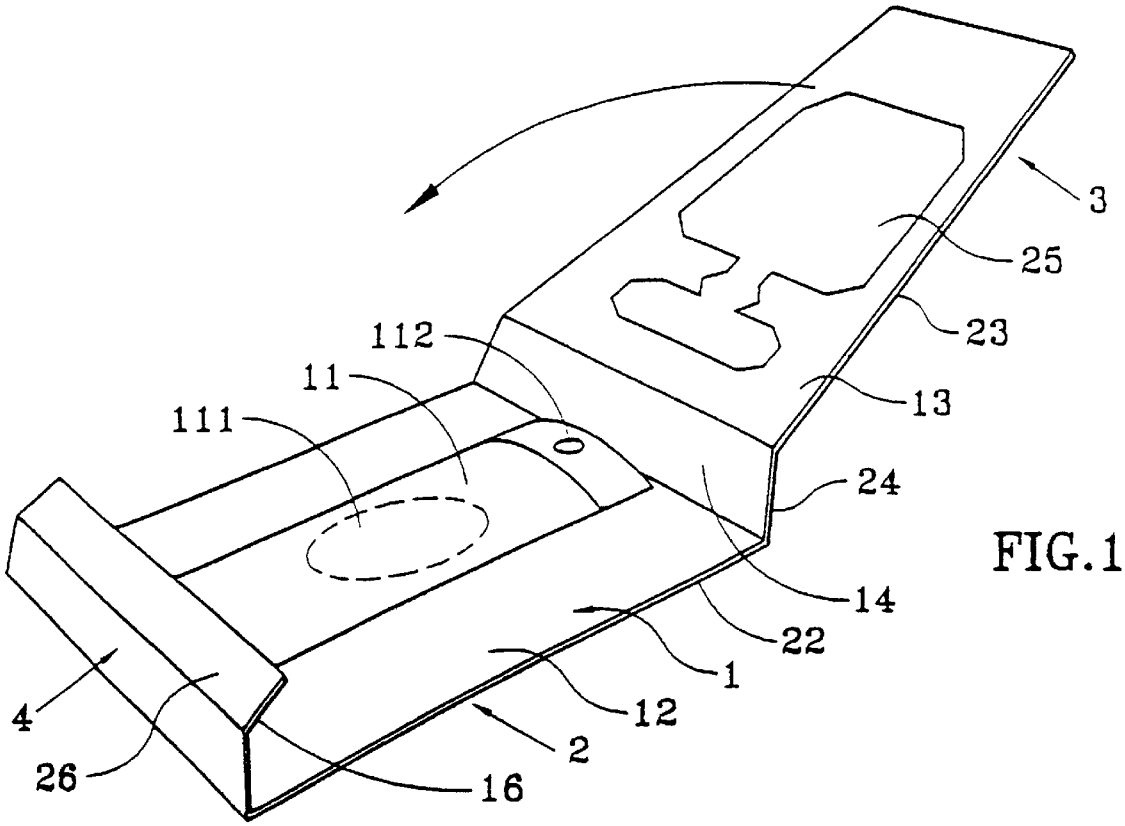
FIG. 1 is a diagrammatic perspective view of a first embodiment of product packaging of the invention.

In the first embodiment shown in FIG. 1, the product packaging may be a sample of a fluid product, such as a perfume. The packaging is essentially made up of two elements, namely a thermoformed sheet designated by overall numerical reference 1, and by a sealing film 2.

The shell may advantageously be made by thermoforming, and it comprises a plane zone 12 which extends around a central zone in relief 11. The zone in relief 11 thus forms a sort of dome which defines the volume of the reservoir in which the product (perfume in this case) is stored. To finish off the reservoir, the sealing film 2 is secured to the lane zone 12 but not to the zone in relief 11. It is therefore essential for the plane zone 12 to extend over the entire periphery of the zone in relief 11. For the purpose of dispensing the perfume, the zone or portion in relief 11 is provided with an outlet orifice 112 which may advantageously be an orifice of a spray nozzle placed inside the reservoir. To extract the perfume through said orifice 112, a portion of the zone in relief 11 defines an actuating wall 111 that can be pushed in by means of a finger, e.g. the thumb, in order to exert pressure on the perfume contained in the reservoir. It is thus advantageous for the shell to be made of a plastics material that is relatively rigid but that is nevertheless flexible so as to enable the zone in relief 11 to return to its initial shape after the actuating wall 111 has been pushed in.

So far, i.e. as described above, this product packaging is of a type that is quite conventional and widely used for perfume samples.

In the invention, this packaging is provided with a flap 3 serving to cover at least a portion of the shell 1, which portion is defined by its plane zone 12 and by its zone in relief 11. In the embodiment shown in FIG. 1, this flap 3 is in the form of an extension to the laminate formed by the shell 1 and by the sealing film 2 which is heat sealed to said shell. The flap 3 is thus made integrally with the laminate 1, 2 defining the reservoir. For this purpose, the shell is extended upwards by a portion 13 connected to the plane zone 12 via an edge portion 14. Similarly, the sealing film is extended upwards by a flap portion 23 which is connected to the portion 22 of the film 2 that forms the back via an edge portion 24. The edge portion 14, 24 is hinged relative to the plane portion 12, 22, along a hinge line defined by the top edge of the zone of the packaging that defines the reservoir. In addition, in its zone 13, the flap is hinged relative to the edge portion 14, 24 about a hinge line parallel to the hinge line shared by the edge portion 14, 24 and the plane zone 12, 22. Thus, the flap 3 is brought back over the portion of the shell that forms the reservoir by pivoting in two places so as to mask the product reservoir.

Since it is plane, the flap 3 offers a large zone on which it is possible to indicate the brand and the type of the product. In the example shown in FIG. 1, the flap 3 is provided.with a window 25 which, once the flap 3 has been brought back over the reservoir, allows a portion of said reservoir to appear. The shape of the window 25 may advantageously be attractive, e.g. it may be perfume bottle shaped. The window 25 may be dimensioned so that it allows the dispensing orifice 112 and advantageously the actuating wall 11 to appear.

In this embodiment, the packaging was also provided with a counter-flap 4 also defined by the laminate made up of the shell 1 and of the film 2. The counter-flap 4 is in the form of a flap that constitutes a catch for holding the free end of the flap 3 when it is brought back over the reservoir. The counter-flap 4 is thus made up of a counter-flap portion 16 formed by an extension to the plane zone 12 and by a counter-flap portion 26 formed by an extension to the back 22 formed by the sealing film.

This embodiment of a perfume dispenser is inspired to a large extent by book-type packaging that is used for matches. In the invention, the flap 3 is fixed permanently to the counter-flap 4, e.g. by adhesive, since the perfume can be dispensed through the window 25. The flap 3 thus constitutes a fixed wall which covers the reservoir at least in part. The flap 3 and the counter-flap 4 define a medium-forming zone on which to indicate the brand and the type of the product, in addition to the zone of the portion in relief 11 that is apparent through the window 25. The flap 3 thus masks the unattractive features of the shell 1 while also increasing the area that can be used for placing the brand and the type of the product.

The second embodiment shown in FIGS. 2, 3*a*, 3*b*, and 4 is a sample of a fluid product such as a perfume or a cream capable of being extracted by pressing on an actuating wall formed by the shell. As in the first embodiment shown in FIG. 1, this packaging comprises a thermoformed shell defining a peripheral plane zone 12 at the center of which a dome 11 projects that co-operates with the back-forming portion 22 of the sealing film 2 to form a reservoir in which the fluid product is stored. In the initial state shown in FIG. 4, the outlet orifice 121 of said sample is closed off by a tab 17 that can be torn off along a score line 122 or folded back along a fold line 122. At the outlet orifice 121, the thermoformed shell defines an outlet duct 113 which may advantageously be provided with a nozzle when the product is sprayable.

In the invention, the sample is provided with a flap 3 formed by the sealing film 2 in the form of a side extension 23 which covers the entire reservoir defined by the portion in relief 11 with the exception of the end of the outlet channel 113 which defines the outlet orifice 121. The flap 23 formed by the sealing film 2 thus extends from one side edge of the plane portion 12 to the other side edge, where it is fixed, e.g. by adhesive or by heat-sealing to the back-forming portion 22 of the sealing film 2. For this purpose, the flap 3 defines a fixing side margin 27 that is applied against the back-forming portion 22, as shown more precisely in FIG. 3*a*. The flap covers the fluid product reservoir permanently so that the dispenser is actuated by pushing in the portion 11 through the flap 3, since the outlet orifice 121 is not masked by said flap. In this example, the flap 3 masks all of the regions of unpleasing appearance of the shell 1, and also offers a very large area on which to position the brand or the type of the product.

Figure 5:
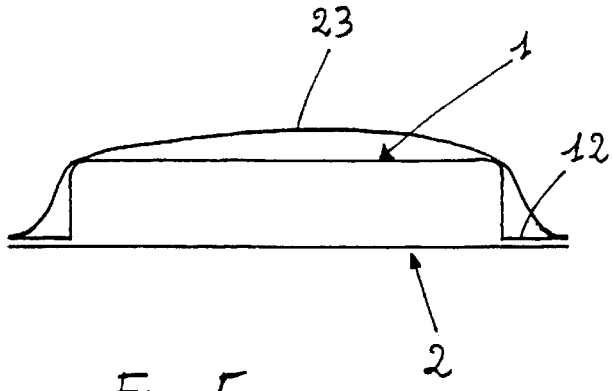
FIG. 5 is a cross-section view of a third embodiment of packaging.
Figure 2:
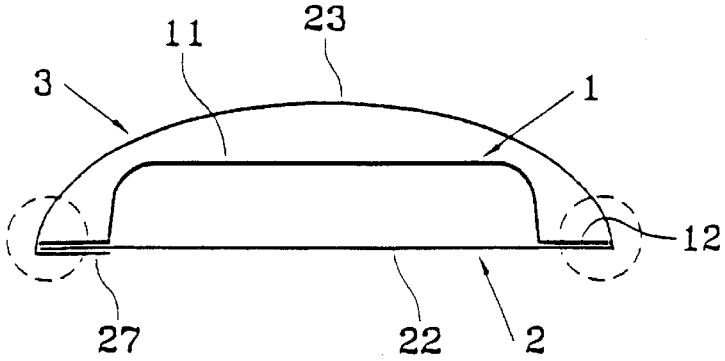
FIGS. 2 and 4 are cross-section views of a second embodiment of product packaging of the invention.
Figure 3A:
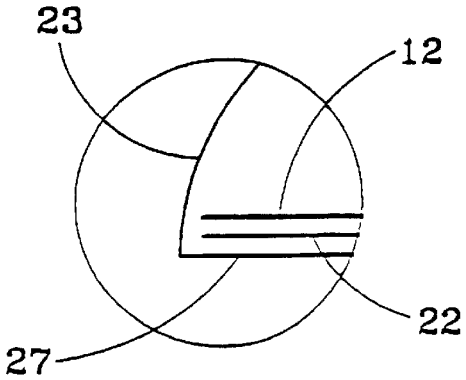
FIGS. 3*a* and 3*b* are enlarged views of details of FIG. 3.
Figure 3B:
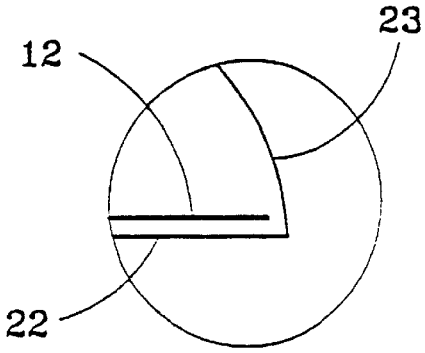
Figure 4:
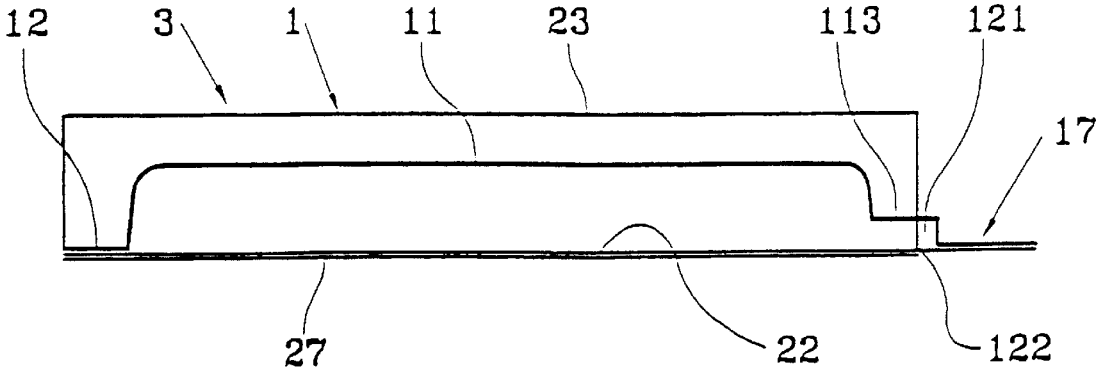

In both of these embodiments, the flap 3 is formed by an extension to the shell, to the film, or to the laminate made up of the shell and of the film. Naturally, although these embodiments are preferred, it is also possible, without going beyond the ambit of the invention, to form a flap of a sheet that is fixed to the shell or to the film, as can be seen in FIG. 5 in which a flexible sheet is fixed to the shell at the plane zone 12.

What is claimed is:

1. A fluid product sample comprising a relatively rigid shell forming a zone in relief and a sealing film connected to the shell except at said zone in relief, so as to form a fluid product reservoir, the shell being covered at least in part by a flexible flap, said flap being secured to one of the shell and the film via two rigid opposite edges of said flap, said zone in relief defining an actuating wall for extracting product by pressing on said reservoir, the product being extracted via an outlet orifice, the flap permanently covering said actuating wall, so that said sample is actuated by pushing in the actuating wall through the flap.

2. Sample according to claim 1, in which the flap is formed by the sealing film.

3. Sample according to claim 1, in which the flap is formed by the shell.

4. Sample according to claim 1, in which the flap is formed by the film and by the shell.

5. Sample according to claim 1, in which the flap is formed by a sheet fixed to the shell or to the film.

6. Sample according to claim 1, in which the flap is provided with at least one window at said at least one reservoir.

7. Sample according to claim 1, in which at least one portion of the sealing film can be peeled off.

8. Sample according to claim 1, in which the shell comprises a plane zone extending around the zone in relief, the sealing film being secured to the plane zone, the flap being secured to the shell or the film at the level of the plane zone on opposite edges with the actuating wall located therebetween.

9. A fluid product sample comprising a relatively rigid shell forming a zone in relief and a sealing film connected to the shell except at said zone in relief, so as to form a fluid product reservoir, the shell being covered at least in part by a flexible flap, said flap being secured to one of the shell and the film via at least a lateral edge of said flap said zone in relief defining an actuating wall for extracting product by pressing on said reservoir, the product being extracted via an outlet orifice, the flap, covering at least in part said product reservoir so that said sample is actuated by pushing in the actuating wall through the flap.

10. Sample according to claim 9, in which the flap is formed by the sealing film.

11. Sample according to claim 9, in which the flap is formed by the shell.

12. Sample according to claim 9, in which the flap is formed by the film and by the shell.

13. Sample according to claim 9, in which the flap is formed by a sheet fixed to the shell or to the film.

14. Sample according to claim 9, in which the flap is provided with at least one window at said at least one reservoir.

15. Sample according to claim 9, in which at least one portion of the sealing film can be peeled off.

16. Sample according to claim 9, in which the flap is secured permanently to one of the shell and the film via two opposite edges thereof.

* * * * *

UNITED STATES PATENT AND TRADEMARK OFFICE

CERTIFICATE OF CORRECTION

PATENT NO. : 6,540,079 B1
DATED : April 1, 2003
INVENTOR(S) : Firmin Garcia and Aline Abergel It is certified that error appears in the above-identified patent and that said Letters Patent is hereby corrected as shown below:

Column 6,
Line 4, “flap said” should be -- flap, said --; and
Line 7, “flap, covering” should be -- flap covering --.

Signed and Sealed this

Tenth Day of June, 2003

JAMES E. ROGAN
*Director of the United States Patent and Trademark Office*